US006724907B1

(12) United States Patent
Chan

(10) Patent No.: US 6,724,907 B1
(45) Date of Patent: Apr. 20, 2004

(54) TWEETER SUPPORT RACK STRUCTURE

(76) Inventor: Yen-Chen Chan, No. 120, Min An East Road, Hsin Chuang City, Taipei Hsien (TW)

( * ) Notice: Subject to any disclaimer, the term of this patent is extended or adjusted under 35 U.S.C. 154(b) by 0 days.

(21) Appl. No.: 10/298,620

(22) Filed: Nov. 15, 2002

(51) Int. Cl.[7] ..... H04R 25/00
(52) U.S. Cl. ..... 381/386; 381/182; 381/387
(58) Field of Search ..... 381/87, 89, 332, 381/182, 186, 386, 387, 390, 395; 181/144, 145, 147

(56) References Cited

U.S. PATENT DOCUMENTS 4,365,114 A * 12/1982 Soma ..... 381/182
4,441,577 A * 4/1984 Kurihara ..... 381/387
6,002,780 A * 12/1999 Espiritu ..... 381/182

* cited by examiner

*Primary Examiner*—Huyen Le
(74) *Attorney, Agent, or Firm*—Ostrolenk, Faber, Gerb & Soffen, LLP

(57) ABSTRACT

A tweeter support rack structure includes a tweeter body, a fixing base, and a support rack body. The tweeter body is fixed on the fixing base by a fixing screw. The fixing base has a top combined with the tweeter body, and a bottom combined with the support rack body. The bottom of the fixing base is provided with at least one locking ratchet. The support rack body has a top combined with the fixing base which may be rotated on the top of the support rack body. The top of the support rack body is provided with multiple locking teeth meshing with the locking ratchet of the fixing base.

7 Claims, 5 Drawing Sheets

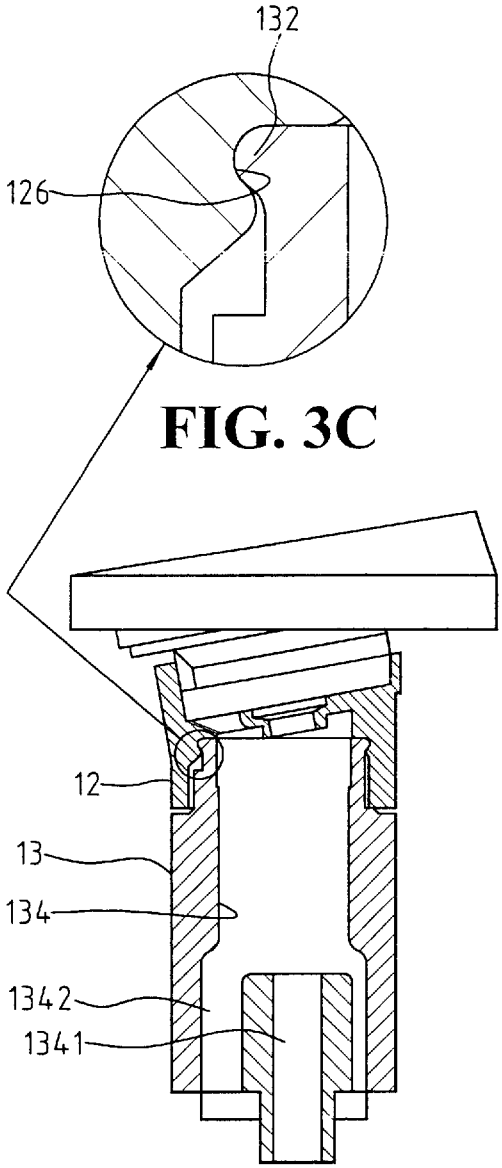
FIG. 3C
FIG. 3A
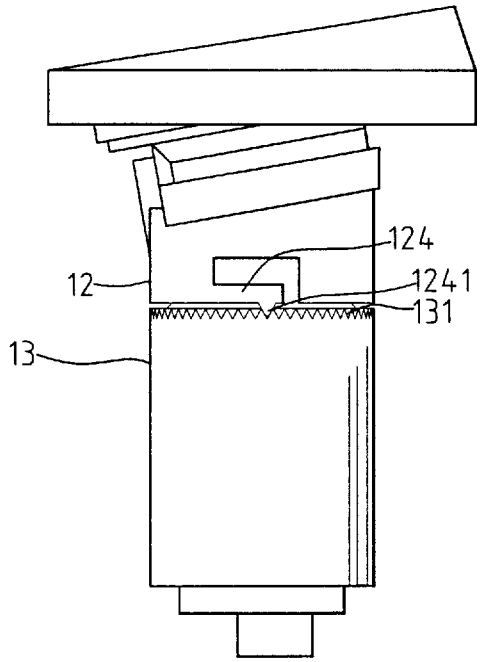
FIG. 3B

TWEETER SUPPORT RACK STRUCTURE

FIELD OF THE INVENTION

The present invention relates to a tweeter support rack structure, and more particularly to a tweeter support rack structure that may be assembled and dismantled easily and conveniently, thereby facilitating assembly and maintenance of the tweeter support rack structure.

BACKGROUND OF THE INVENTION

A conventional tweeter in accordance with the prior art is directly mounted on the center of a woofer or independently mounted in a special site, such as the inside of a car. However, the conventional tweeter has a fixed structure, and cannot be assembled and dismantled easily, thereby causing inconvenience in maintenance. In addition, the output direction of the sound of the conventional tweeter is fixed and cannot be adjusted, so that the conventional tweeter body cannot be rotated to adjust its direction toward the optimum output angle, thereby decreasing the output effect of the conventional tweeter.

SUMMARY OF THE INVENTION

The present invention has arisen to mitigate and/or obviate the disadvantage of the conventional tweeter.

The primary objective of the present invention is to provide a tweeter support rack structure that may be assembled and dismantled easily and conveniently, thereby facilitating assembly and maintenance of the tweeter support rack structure.

Another objective of the present invention is to provide a tweeter support rack structure, wherein the fixing base may be rotated on the support rack body, so that the tweeter body may be rotated to adjust its direction toward the optimum output angle, thereby enhancing the optimum output effect of the tweeter body.

A further objective of the present invention is to provide a tweeter support rack structure, wherein the fixing base may be positioned on the support rack body temporarily by engagement of the locking ratchet tooth of the fixing base with the locking teeth of the support rack body, thereby preventing the fixing base together with the tweeter body from freely swiveling on the support rack body unintentionally or unexpectedly due to vibration or an external force.

A further objective of the present invention is to provide a tweeter support rack structure, wherein the locking convex of the support rack body may be forced into the locking concave of the fixing base, so that the fixing base may be combined with and may be rotated on the support rack body, without needing assistance of any tool.

A further objective of the present invention is to provide a tweeter support rack structure, wherein the primary locking block of the fixing base may be stopped by the secondary locking block of the support rack body when the fixing base is rotated on the support rack body, so that the stroke of rotation of the fixing base together with the tweeter body on the support rack body may be limited to be smaller than 360 degrees, thereby preventing the conducting wire of the tweeter body from being tangled or torn due to the excessive rotation of the fixing base.

In accordance with the present invention, there is provided a tweeter support rack structure, comprising a tweeter body, a fixing base, and a support rack body, wherein:

the tweeter body is fixed on the fixing base by a fixing screw; the fixing base has a top combined with the tweeter body, and a bottom combined with the support rack body, the bottom of the fixing base is provided with at least one locking ratchet; and the support rack body has a top combined with the fixing base which may be rotated on the top of the support rack body, the top of the support rack body is provided with multiple locking teeth meshing with the locking ratchet of the fixing base.

Preferably, the fixing base has an oblique top face having a center formed with a through hole for passage of the fixing screw and having an edge formed with a conducting wire passage hole, and the tweeter body is provided with a conducting wire that may pass through the conducting wire passage hole of the fixing base.

Preferably, the tweeter body has a periphery formed with a locking recess, and the top face of the fixing base has a periphery provided with a locking strip locked in the locking recess of the tweeter body.

Preferably, the locking ratchet includes a locking ratchet flexible strip extended from the bottom of the fixing base, and a locking ratchet tooth formed on a distal end of the locking ratchet flexible strip.

Preferably, the fixing base has an inner wall formed with an annular locking concave, and the top of the support rack body is provided with an annular locking convex that is closely fit into the locking concave of the fixing base.

Preferably, the inner wall of the fixing base is provided with a primary locking block, and the top of the support rack body has an outer wall provided with a secondary locking block for limiting movement of the primary locking block of the fixing base.

Further benefits and advantages of the present invention will become apparent after a careful reading of the detailed description with appropriate reference to the accompanying drawings.

BRIEF DESCRIPTION OF THE DRAWINGS

FIG. 3A is a side plan cross-sectional view of the tweeter support rack structure as shown in FIG. 1;

FIG. 3B is a partially cut-away enlarged view of the tweeter support rack structure as shown in FIG. 3A;

FIG. 3C is a side plan view of the tweeter support rack structure as shown in FIG. 1;

DETAILED DESCRIPTION OF THE INVENTION

Figure 1:
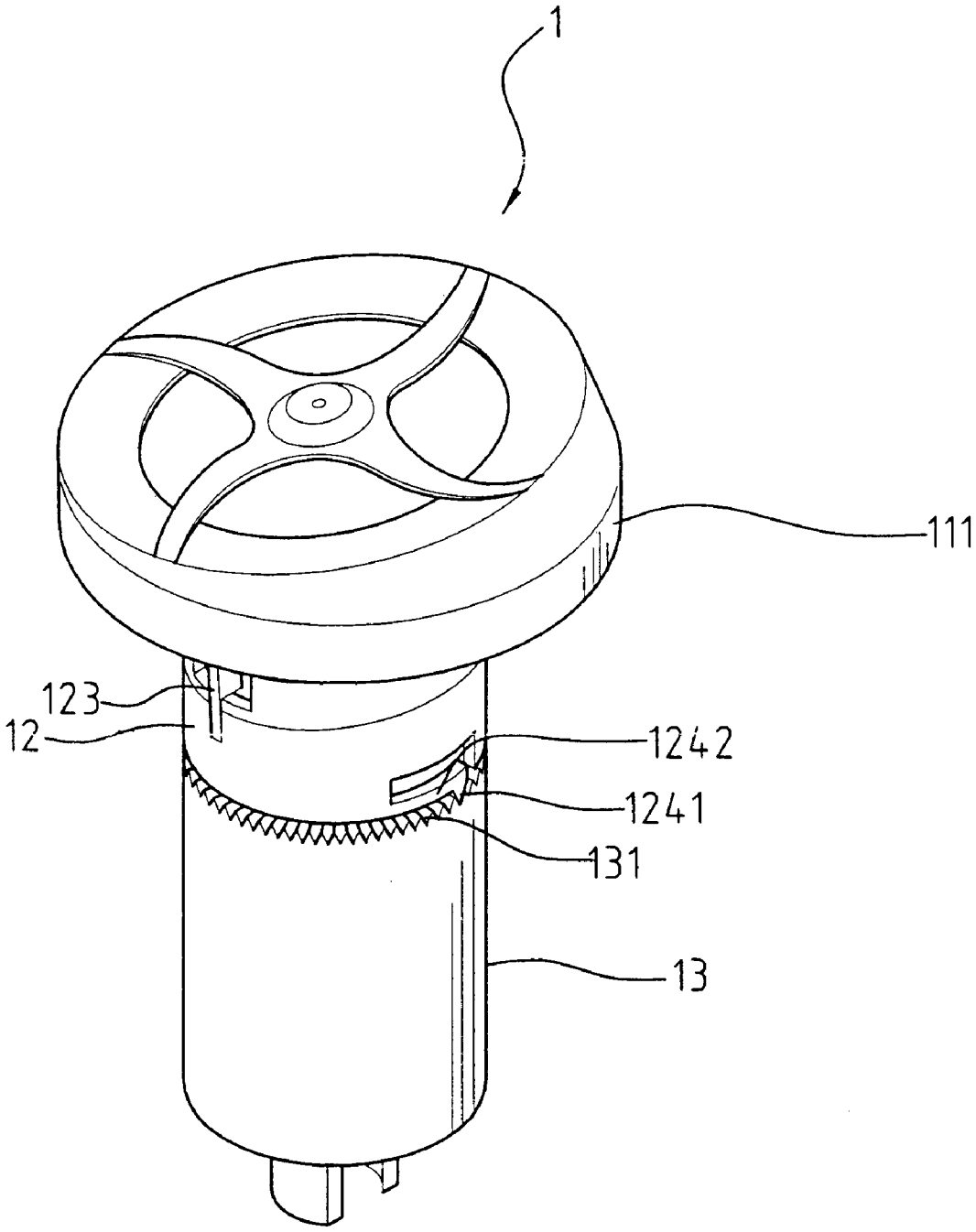
FIG. 1 is a perspective view of a tweeter support rack structure in accordance with a preferred embodiment of the present invention.
Figure 2:
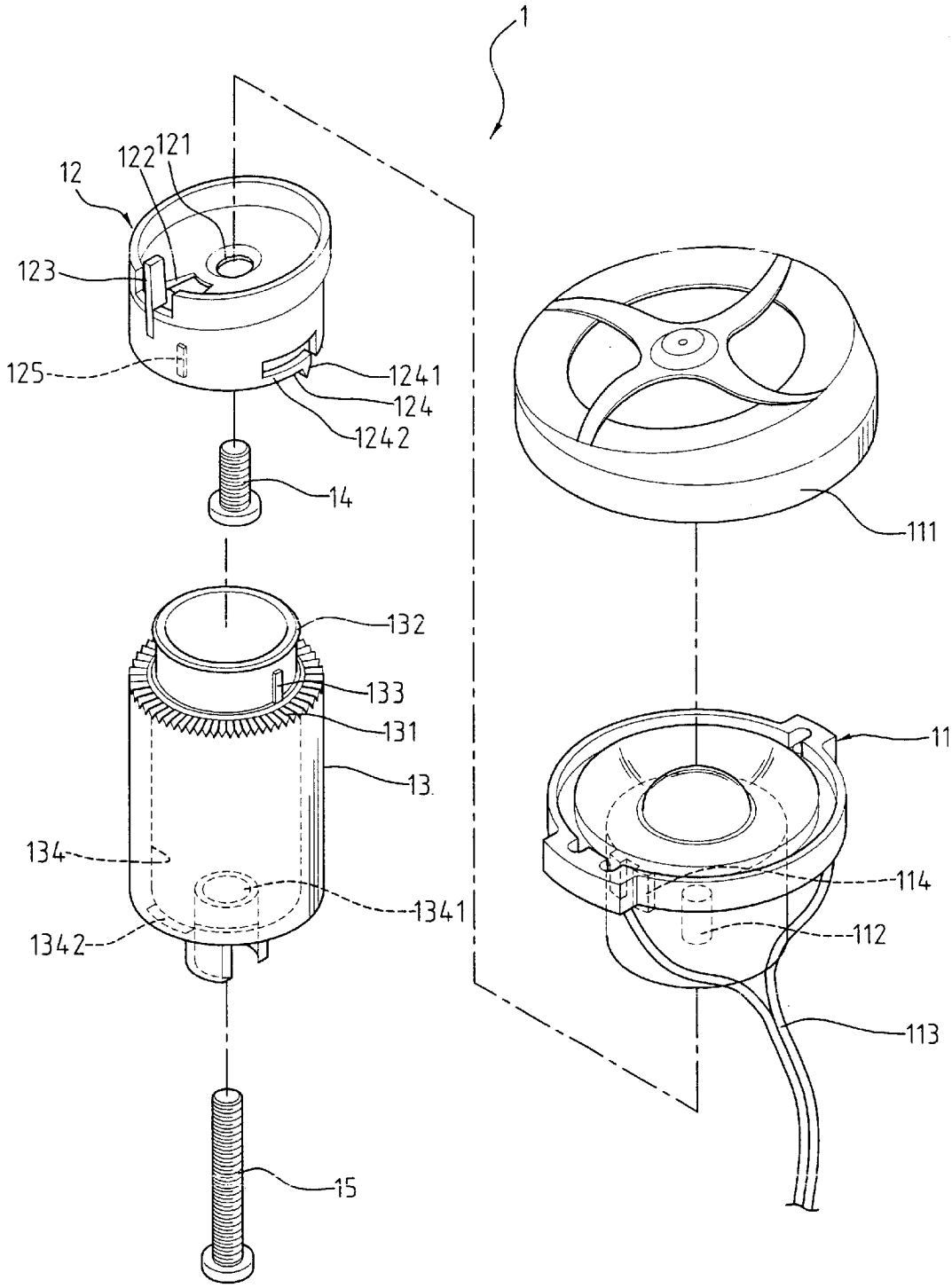
FIG. 2 is an exploded perspective view of a tweeter support rack structure as shown in FIG. 1.

Referring to the drawings and initially to FIGS. 1 and 2, a tweeter support rack structure 1 in accordance with a preferred embodiment of the present invention comprises a tweeter body 11, a fixing base 12, and a support rack body 13.

A top cover 111 is secured on a top of the tweeter body 11. The tweeter body 11 has a bottom formed with a screw bore 112 for engagement of a fixing screw 14, thereby securing the tweeter body 11 on the fixing base 12.

The fixing base 12 has an oblique top face having a center formed with a through hole 121 and an edge formed with a conducting wire passage hole 122. The fixing screw 14 is extended through the through hole 121 of the fixing base 12, and is screwed into the screw bore 112 of the tweeter body 11, thereby securing the tweeter body 11 on the fixing base 12. The tweeter body 11 is provided with a conducting wire 113 that may pass through the conducting wire passage hole 122 of the fixing base 12.

The tweeter body 11 has a periphery formed with a locking recess 114. The oblique top face of the fixing base 12 has a periphery provided with a locking strip 123 locked in the locking recess 114 of the tweeter body 11, thereby preventing the tweeter body 11 from being rotated relative to the fixing base 12 after the tweeter body 11 is secured on the fixing base 12.

The fixing base 12 has a bottom provided with at least one locking ratchet 124 (preferably two locking ratchets). The locking ratchet 124 includes a locking ratchet flexible strip 1242 extended from the bottom of the fixing base 12, and a locking ratchet tooth 1241 formed on a distal end of the locking ratchet flexible strip 1242.

The support rack body 13 has a top provided with multiple annular locking teeth 131 meshing with the locking ratchet tooth 1241 of the fixing base 12, so that when the fixing base 12 is combined with the support rack body 13, the fixing base 12 together with the tweeter body 11 will not swivel on the support rack body 13 due to vibration or an external force.

It is to be noted that, the gap between the fixing base 12 and the support rack body 13 is enlarged due to the heat expansion effect, so that the fixing base 12 together with the tweeter body 11 will easily swivel on the support rack body 13.

Thus, in accordance with a preferred embodiment of the present invention, the fixing base 12 may be positioned on the support rack body 13 temporarily by engagement of the locking ratchet tooth 1241 of the fixing base 12 with the locking teeth 131 of the support rack body 13. In such a manner, the user has to exert a force on the fixing base 12, so as to rotate the fixing base 12 on the support rack body 13, thereby preventing the fixing base 12 together with the tweeter body 11 from swiveling on the support rack body 13 freely due to vibration or an external force.

The fixing base 12 has an inner wall formed with an annular locking concave 126 (see FIG. 3B). The top of the support rack body 13 is provided with an annular locking convex 132 that is closely fit into the locking concave 126 of the fixing base 12, so that the fixing base 12 may be fixed on the support rack body 13 rigidly and stably, and may be rotated on the support rack body 13 freely.

Thus, the user only needs to slightly exert a force to force and insert the locking convex 132 of the support rack body 13 into the locking concave 126 of the fixing base 12, so that the fixing base 12 may be combined with the support rack body 13, without needing assistance of any tool.

The inner wall of the fixing base 12 is provided with a primary locking block 125. The top of the support rack body 13 has an outer wall provided with a secondary locking block 133. Thus, when the fixing base 12 is rotated on the support rack body 13, the primary locking block 125 of the fixing base 12 will be stopped by the secondary locking block 133 of the support rack body 13, so as to limit the stroke of rotation of the fixing base 12 on the support rack body 13, thereby preventing the conducting wire 113 of the tweeter body 11 from being tangled or torn due to the excessive numbers of rotation of the fixing base 12.

The support rack body 13 has an inner wall formed with a hollow passage 134. The inner wall of the support rack body 13 has bottom provided with threaded post 1341 and formed with a conducting wire escape hole 1342 communicated with the hollow passage 134. Thus, the conducting wire 113 of the tweeter body 11 may in turn pass through the conducting wire passage hole 122 of the fixing base 12, the hollow passage 134 and the conducting wire escape hole 1342 of the support rack body 13, and may extend outward from the conducting wire escape hole 1342 of the support rack body 13. In addition, a connecting screw 15 may be screwed into the threaded post 1341 of the support rack body 13, so that the support rack body 13 of the tweeter support rack structure 1 of the present invention may be fixed on a mounting site, such as the inside of a car, the center of a horn or the like.

Referring to FIGS. 3A, 3B and 3C, the top cover 111 is secured on the top of the tweeter body 11. The tweeter body 11 is fixed on the fixing base 12 by the fixing screw 14 being screwed into the screw bore 112. The fixing base 12 has an oblique top face, so that the tweeter body 11 may be disposed at an oblique state after the tweeter body 11 is fixed on the fixing base 12. Thus, the tweeter body 11 may be rotated to adjust its direction toward the optimum output angle, thereby enhancing the optimum output effect of the tweeter body 11.

In addition, when the tweeter body 11 is combined with the fixing base 12, the conducting wire 113 of the tweeter body 11 may in turn pass through the conducting wire passage hole 122 of the fixing base 12, and may be received in the hollow passage 134 of the support rack body 13, thereby preventing the conducting wire 113 of the tweeter body 11 from being exposed outward.

Further, the locking convex 132 of the support rack body 13 may be inserted into and locked in the locking concave 126 of the fixing base 12, so that the fixing base 12 may be combined with the support rack body 13.

Finally, the conducting wire 113 of the tweeter body 11 may in turn pass through the hollow passage 134 of the support rack body 13, and may extend outward from the conducting wire escape hole 1342 of the support rack body 13. In addition, the connecting screw 15 may be screwed into the threaded post 1341 of the support rack body 13, so that the support rack body 13 of the tweeter support rack structure 1 of the present invention may be fixed on a mounting site, such as the inside of a car, the center of a horn or the like.

When the locking convex 132 of the support rack body 13 is locked in the locking concave 126 of the fixing base 12, the fixing base 12 may be rotated on the support rack body 13 freely. Thus, the fixing base 12 may be positioned on the support rack body 13 temporarily by engagement of the locking ratchet tooth 1241 of the fixing base 12 with the locking teeth 131 of the support rack body 13. In such a manner, the user has to exert a force on the fixing base 12, so as to force and rotate the fixing base 12 on the support rack body 13, thereby preventing the fixing base 12 together with the tweeter body 11 from freely swiveling on the support rack body 13 unintentionally or unexpectedly due to vibration or an external force.

Figure 4:
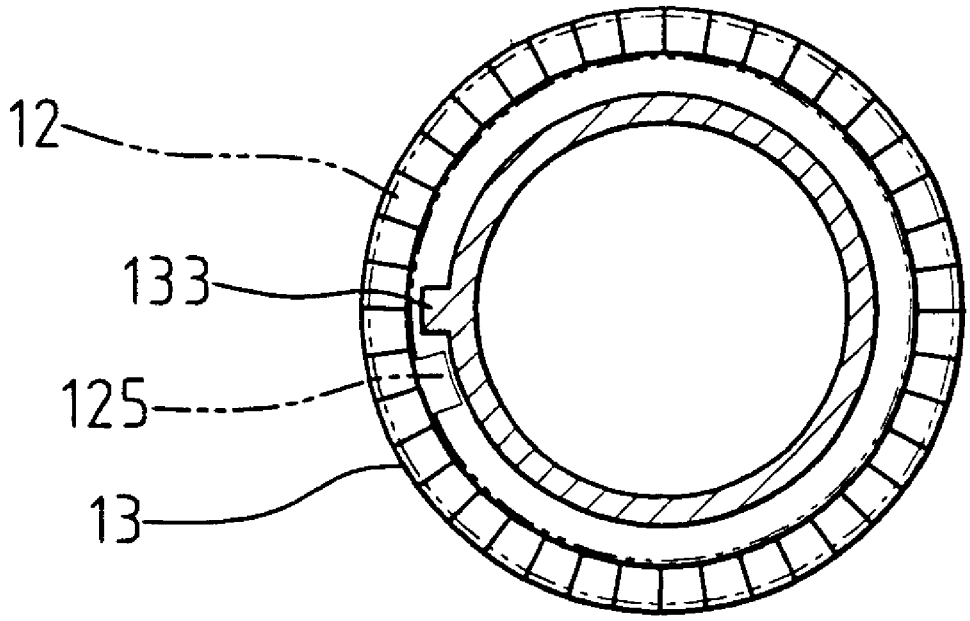
FIG. 4 is a top plan cross-sectional view of the tweeter support rack structure as shown in FIG. 1.

Referring to FIG. 4, when the fixing base 12 is rotated on the support rack body 13, the primary locking block 125 of the fixing base 12 may be stopped by the secondary locking block 133 of the support rack body 13, so that the stroke of rotation of the fixing base 12 together with the tweeter body 11 on the support rack body 13 may be limited to be smaller than 360 degrees, thereby preventing the conducting wire 113 of the tweeter body 11 from being tangled or torn due to the excessive rotation of the fixing base 12.

Figure 5:
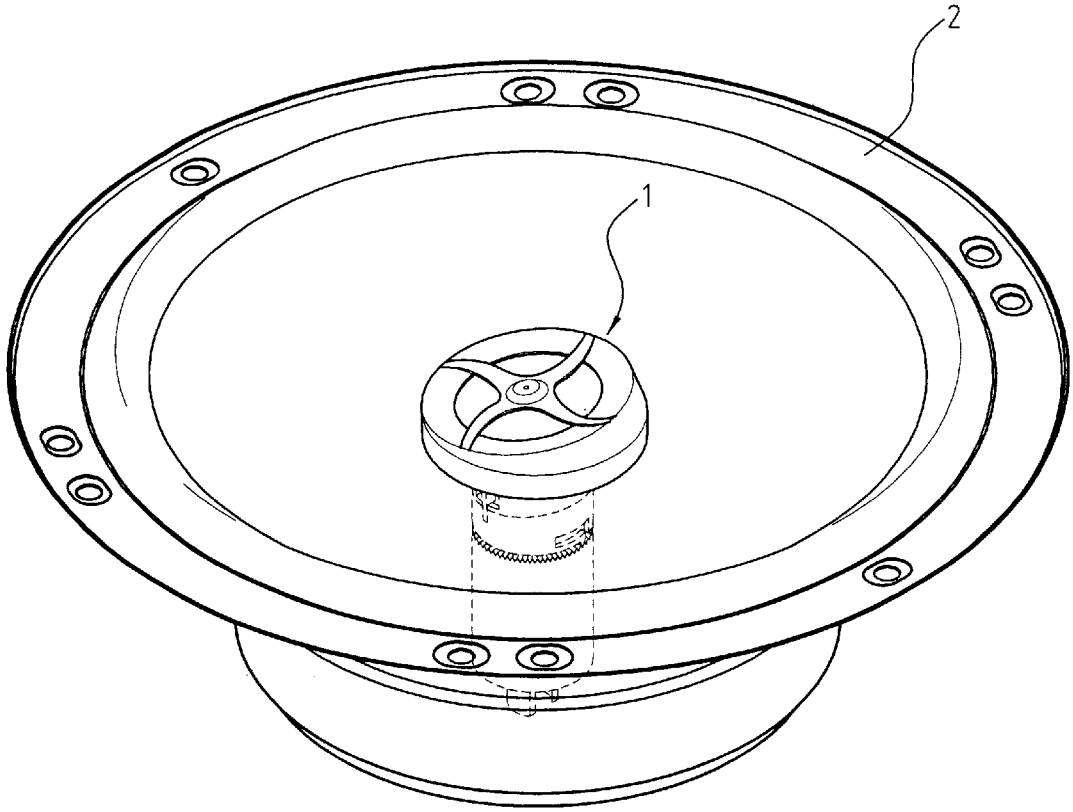
FIG. 5 is a schematic perspective view of a tweeter support rack structure in accordance with a preferred embodiment of the present invention.

Referring to FIG. 5, the tweeter support rack structure 1 in accordance with a preferred embodiment of the present invention comprises a tweeter body 11, a fixing base 12, and a support rack body 13. Thus, the tweeter support rack structure 1 of the present invention may be fixed on a mounting site, such as the center of a horn 2, the inside of a car, or the like by the connecting screw 15.

Accordingly, the tweeter support rack structure 1 in accordance with the present invention has the following advantages.

1. The tweeter support rack structure may be assembled and dismantled easily and conveniently, thereby facilitating assembly and maintenance of the tweeter support rack structure.

2. The fixing base may be rotated on the support rack body, so that the tweeter body may be rotated to adjust its direction toward the optimum output angle, thereby enhancing the optimum output effect of the tweeter body.

3. The fixing base may be positioned on the support rack body temporarily by engagement of the locking ratchet tooth of the fixing base with the locking teeth of the support rack body, thereby preventing the fixing base together with the tweeter body from freely swiveling on the support rack body unintentionally or unexpectedly due to vibration or an external force.

4. The locking convex of the support rack body may be forced into the locking concave of the fixing base, so that the fixing base may be combined with and may be rotated on the support rack body, without needing assistance of any tool.

5. The primary locking block of the fixing base may be stopped by the secondary locking block of the support rack body when the fixing base is rotated on the support rack body, so that the stroke of rotation of the fixing base together with the tweeter body on the support rack body may be limited to be smaller than 360 degrees, thereby preventing the conducting wire of the tweeter body from being tangled or torn due to the excessive rotation of the fixing base.

Although the invention has been explained in relation to its preferred embodiment as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A tweeter support rack structure, comprising a tweeter body, a fixing base, and a support rack body, wherein:

the tweeter body is fixed on the fixing base by a fixing screw;

the fixing base has a top combined with the tweeter body, wherein the fixing base has an oblique top face having a center formed with a through hole for passage of the fixing screw and has an edge formed with a conducting wire passage hole, the tweeter body is provided with a conducting wire that may pass through the conducting wire passage hole of the fixing base;

the fixing base has a bottom combined with the support rack body, the bottom of the fixing base is provided with at least one locking ratchet; and the support rack body has a top combined with the fixing base which may be rotated on the top of the support rack body, the top of the support rack body is provided with multiple locking teeth meshing with the locking ratchet of the fixing base.

2. The tweeter support rack structure in accordance with claim 1, further comprising a top cover secured on a top of the tweeter body.

3. The tweeter support rack structure in accordance with claim 1, wherein the bottom of the fixing base is provided with two of the locking ratchets.

4. The tweeter support rack structure in accordance with claim 1, wherein the locking ratchet includes a locking ratchet flexible strip extended from the bottom of the fixing base, and a locking ratchet tooth formed on a distal end of the locking ratchet flexible strip.

5. A tweeter support rack structure, comprising a tweeter body, a fixing base, and a support rack body, wherein:

the tweeter body is fixed on the fixing base by a fixing screw;

the fixing base has a top combined with the tweeter body, and has a bottom combined with the support rack body, the bottom of the fixing base is provided with at least one locking ratchet;

the support rack body has a top combined with the fixing base which may be rotated on the top of the support rack body, the top of the support rack body is provided with multiple locking teeth meshing with the locking ratchet of the fixing base; and wherein the tweeter body has a periphery formed with a locking recess, and the top face of the fixing base has a periphery provided with a locking strip locked in the locking recess of the tweeter body.

6. A tweeter support rack structure, comprising a tweeter body, a fixing base, and a support rack body, wherein:

the tweeter body is fixed on the fixing base by a fixing screw;

the fixing base has a top combined with the tweeter body, and has a bottom combined with the support rack body, the bottom of the fixing base is provided with at least one locking ratchet;

the support rack body has a top combined with the fixing base which may be rotated on the top of the support rack body, the top of the support rack body is provided with multiple locking teeth meshing with the locking ratchet of the fixing base; and wherein the fixing base has an inner wall formed with an annular locking concave, and the top of the support rack body is provided with an annular locking convex that is closely fit into the locking concave of the fixing base.

7. A tweeter support rack structure, comprising a tweeter body, a fixing base, and a support rack body, wherein:

the tweeter body is fixed on the fixing base by a fixing screw;

the fixing base has a top combined with the tweeter body, and has a bottom combined with the support rack body, the bottom of the fixing base is provided with at least one locking ratchet;

the support rack body has a top combined with the fixing base which may be rotated on the top of the support rack body, the top of the support rack body is provided with multiple locking teeth meshing with the locking ratchet of the fixing base; and wherein the inner wall of the fixing base is provided with a primary locking block, and the top of the support rack body has an outer wall provided with a secondary locking block for limiting movement of the primary locking block of the fixing base.

* * * * *